US009808051B1

(12) United States Patent
Majercak

(10) Patent No.: US 9,808,051 B1
(45) Date of Patent: Nov. 7, 2017

(54) REMOVABLE FASTENER FOR A LOOP SHANK BUTTON

(71) Applicant: Kenneth Majercak, New Carlisle, OH (US)

(72) Inventor: Kenneth Majercak, New Carlisle, OH (US)

( * ) Notice: Subject to any disclaimer, the term of this patent is extended or adjusted under 35 U.S.C. 154(b) by 0 days.

(21) Appl. No.: 15/267,588

(22) Filed: Sep. 16, 2016

Related U.S. Application Data

(60) Provisional application No. 62/220,338, filed on Sep. 18, 2015.

(51) Int. Cl.
*A44B 1/38* (2006.01)
*A44B 1/04* (2006.01)

(52) U.S. Cl.
CPC . *A44B 1/38* (2013.01); *A44B 1/04* (2013.01)

(58) Field of Classification Search
CPC .. A44B 1/185; A44B 1/04; A44B 1/36; Y10T 24/36; Y10T 24/17; Y10T 24/189; Y10T 24/188; Y10T 24/1934; Y10T 24/3685; Y10T 24/3691; Y10T 24/3651; Y10T 24/3655
USPC ..... 24/113 MP, 106
See application file for complete search history.

(56) References Cited

U.S. PATENT DOCUMENTS 73,735 A * 1/1868 Magrane ..... A44B 1/36 24/100.5
96,689 A * 11/1869 Geiger et al. ..... A44B 1/36 24/106
114,200 A * 4/1871 Richmond ..... A44B 1/36 24/106
153,282 A * 7/1874 Robinson ..... A44B 1/36 24/106
353,921 A * 12/1886 Church ..... A44B 1/36 24/106
795,315 A * 7/1905 Stanley ..... A44B 1/28 24/104
880,725 A * 3/1908 Effenberger ..... A44B 1/36 24/106
889,133 A * 5/1908 Hyde, Jr. ..... A44B 1/28 24/104
892,784 A * 7/1908 Warner ..... A44B 1/28 24/103
925,193 A * 6/1909 Kaag ..... A44B 1/36 24/106
967,978 A * 8/1910 Rosenthal ..... A44B 1/36 24/106

(Continued)

*Primary Examiner* — Robert J Sandy
*Assistant Examiner* — Rowland Do
(74) *Attorney, Agent, or Firm* — Mark A. Navarre

(57) ABSTRACT

An improved one-piece fastener for retaining a loop shank button in the buttonhole of a garment. The fastener is in the form of a planar disk having a solid margin and a central portion within the margin that is notched to define a pair of mutually parallel deflectable legs sized and spaced to permit their partial insertion through the loop shank of the button. The legs of the fastener are contoured to define a detent position in which the loop shank seats to securely attach the fastener to the loop shank and thereby retain the loop shank button in the buttonhole of the garment. One longitudinal end of the fastener margin is provided with an extension or tab by which a user can conveniently grasp the fastener during its installation and removal.

5 Claims, 1 Drawing Sheet

(56) References Cited

U.S. PATENT DOCUMENTS

| | | | | | |
|---|---|---|---|---|---|
| 1,065,082 | A * | 6/1913 | Saunders | A44B 1/36 | 24/103 |
| 1,080,604 | A * | 12/1913 | Stone | A44B 1/36 | 24/106 |
| 2,169,708 | A * | 8/1939 | O'Callaghan | F16B 5/06 | 174/395 |
| 3,439,439 | A * | 4/1969 | Stimson | A44B 1/04 | 24/114.9 |
| 2004/0088832 | A1 | 5/2004 | Groves | | |
| 2006/0042055 | A1 * | 3/2006 | Ho | A41F 11/04 | 24/668 |
| 2015/0208767 | A1 | 7/2015 | Shafer | | |

* cited by examiner

REMOVABLE FASTENER FOR A LOOP SHANK BUTTON

RELATED APPLICATIONS

This application claims priority based on the Provisional Patent Application No. 62/220,338, filed Sep. 18, 2015.

TECHNICAL FIELD

This invention relates to a fastening apparatus for retaining a loop shank button in the buttonhole of a garment.

BACKGROUND OF THE INVENTION

Specialized garments incorporating custom or fragile buttons, such as police and fire department uniforms or costumes, utilize loop shank buttons that can be removed prior to laundering to save wear and tear on the buttons and garments. A simple button of this type is generally designated by the reference numeral 10 in the Prior Art illustration of FIG. 1, where the ornamental body 10*a* of the button 10 has a back face 12 from which protrudes a shank 14 in the form of a wire loop. The shank 14, which can be formed of a material other than wire, is inserted through the buttonhole 16 of a garment 18 such as a shirt, and a removable fastener arrangement, generally designated by the reference numeral 20, is secured onto the loop shank 14 to retain the button 10 in the garment 18 during its use. In the Prior Art illustration of FIG. 1, the fastener arrangement 20 includes two pieces: a washer 22 with a slot opening 22*a*, and a small wire spring clip 24 such as a so-called R-clip. The washer 22 is inserted over the loop shank 14 in contact with the garment 18, and the spring clip 24 is fastened onto the loop shank 14; since the spring clip 24 can shift on the loop shank 14, the washer 22 is needed to prevent the spring clip 24 from being inadvertently pulled through the buttonhole 16 of garment 18.

Obviously, it can be tedious and time-consuming to attach or remove multiple loop shank buttons using the aforementioned two-piece fastener arrangement 20. Accordingly, what is needed is a one-piece fastener arrangement that securely retains a loop shank button, while being easier to install and remove.

SUMMARY OF THE INVENTION

The present invention is directed to an improved fastener for retaining a loop shank button in the buttonhole of a garment, and more particularly to a one-piece fastener that serves the combined functions of the conventional washer and spring clip. A fastener according to this invention is in the form of a planar disk having a peripheral or marginal portion and a central or interior portion that is partially cut out to define a pair of mutually parallel deflectable legs sized and spaced to permit their partial insertion through the loop shank of the button. The legs deflect toward one another as they are inserted into the loop shank, and outer peripheries of the legs depend inwardly at a central point along their length to define a detent position in which the loop shank seats to ensure a secure and slip-free attachment of the legs to the loop shank. The marginal portion of the fastener extends laterally and longitudinally outward from the legs in the form of a rounded disk to prevent the fastener from being inadvertently pulled through the buttonhole of the garment, and one longitudinal end of the body is provided with an extension or tab by which a user can conveniently grasp the fastener during its installation and removal.

In a first embodiment of the invention, the marginal portion of the fastener is open on one end to expose the ends of the deflectable legs. And in a second embodiment of the invention, the marginal portion completely surrounds the deflectable legs, leaving an open space between the marginal portion and the free ends of the legs sufficient in length and width to accommodate the loop shank of a button.

DESCRIPTION OF THE PREFERRED EMBODIMENT

Figure 2:
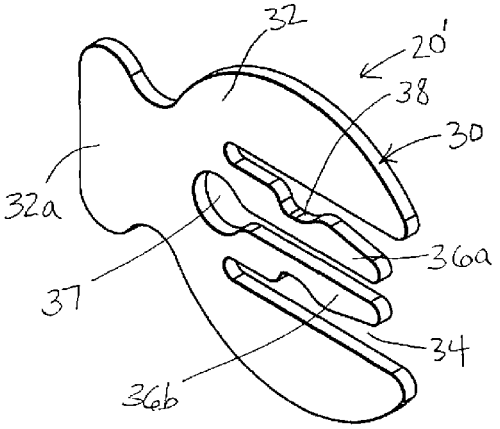
FIG. 2 is a perspective view of a removable fastener for a loop shank button according to a first embodiment of this invention.
Figure 3:
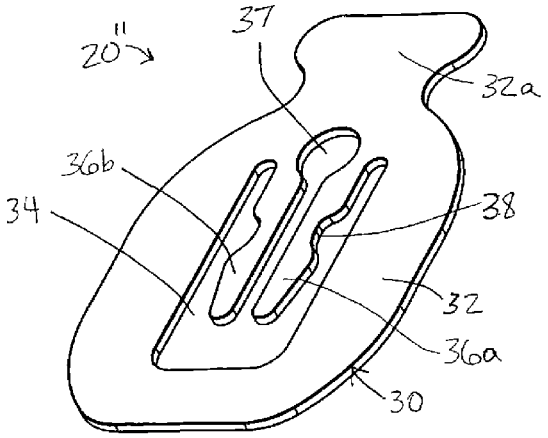
FIG. 3 is a perspective view of a removable fastener for a loop shank button according to a second embodiment of this invention.
Figure 4:
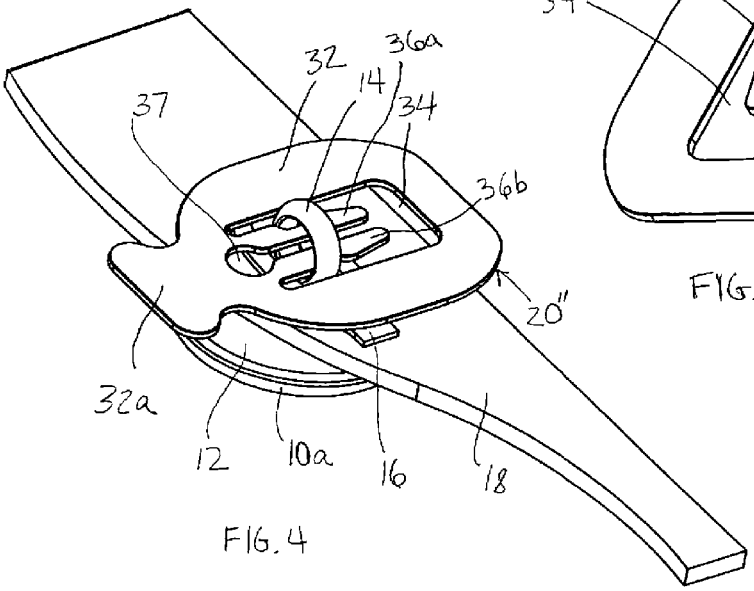
FIG. 4 is a perspective view of the removable fastener of FIG. 3 as installed on a loop shank button retained in the buttonhole of a garment.

Referring to FIGS. 2-4, first and second embodiments of the removable fastener of this invention are generally designated by the reference numerals 20' and 20", respectively. Both embodiments are in the form of a planar disk having a solid marginal portion 32 and a central portion 34 within the marginal portion 32, the central portion 34 being notched or cut out to define a pair of mutually parallel deflectable legs 36*a*, 36*b* sized and spaced to permit their insertion through the loop shank 14 of a loop shank button 10. The open space between the legs 36*a*, 36*b* terminates in an enlarged circular opening 37 near the point where the legs 36*a*, 36*b* join the marginal portion 32; this narrows the deflectable legs 36*a*, 36*b* at their root or base to render them more easily deflectable. Finally, the legs 36*a*, 36*b* are contoured or notched approximately at mid-length as indicated by the reference numeral 38 to define a detent position in which the button loop shank 14 seats to securely attach the fastener 20', 20" to the loop shank 14 and thereby retain the loop shank button 10 in the garment buttonhole 16.

Also, it will be noted that the marginal portions 32 of the fasteners 20" and 20" extend both laterally and longitudinally outward from the deflectable legs 36*a*, 36*b* in the shape of a rounded disk. This effectively serves the function of the prior art slotted washer 22 in that it prevents the fastener 20', 20" from being inadvertently pulled through the buttonhole 16 of the garment 18. Furthermore, the end of the marginal portion 32 nearest the base of the deflectable legs 36*a*, 36*b* extends longitudinally outward away from the legs 36*a* 36*b* to form a tab 32*a* by which a user can conveniently grasp the fastener 20', 20" during its installation and removal.

Referring particularly to FIG. 2, a fastener 20' according to the first embodiment of the invention is characterized by a margin 32 that is open longitudinally outboard of the ends of the legs 36*a*, 36*b*. In other words, the margin 32 is open on one end to expose the ends of the legs 36*a*, 36*b*.

Referring particularly to FIGS. 3-4, a fastener 20" according to the second embodiment of the invention is characterized by a margin 32 that completely surrounds the legs 36*a*, 36*b*, leaving an open space 40 between the margin 32 and the free ends of the legs 36*a*, 36*b* sufficient in length and width to accommodate the loop shank 14 of the button 10. With either embodiment, the user grasps the tab 32*a* to install and remove the fastener 20', 20", but with the fastener 20" of FIGS. 3-4, the user can additionally push against the end of the margin 32 opposite the tab 32*a* to assist in the removal of the fastener 20".

In practice, the user installs the fastener 20', 20" of this invention by grasping the tab 32*a* and positioning the fastener 20', 20" such that the ends of the legs 36*a*, 36*b* are centered in the opening of the loop shank 14, and then pushing the fastener 20', 20" toward the loop shank 14 so that the legs 36*a*, 36*b* deflect inwardly as they slide into the opening of the loop shank 14. When the loop shank 14 reaches the leg notches 38, the legs 36*a*, 36*b* deflect partially outward, and resist further movement of the fastener 20', 20" with respect to the loop shank 14. FIG. 4 depicts the fastener 20" so installed. When it is desired to remove the fastener 20', 20" from the loop shank 14 to release the button 10, the user again grasps the tab 32*a* and pulls the fastener 20', 20" away from the loop shank 14; the legs 36*a*, 36*b* initially deflect inward as the loop shank 14 moves out of the detent position, and then deflect outward as the legs 36*a*, 36*b* are withdrawn from the loop shank 14. In the case of the fastener 20" of FIG. 3, the user can additionally push against the end of the margin 32 opposite the tab 32*a* to assist in its removal from the loop shank 14.

Apart from the tab 32*a*, the fastener 20', 20" has a generally circular and rounded shape sufficiently large so that it cannot be inadvertently pulled through the buttonhole 16 of the garment 18 to which the button 10 is fastened. In practice, this means that the margin 32 should have a width and length of at least 15 mm.

Preferably, the fastener 20', 20" is constructed of a metal such as tempered spring steel, having a thickness of approximately 0.5 mm. But it is conceivable that it could be alternatively constructed of a suitable plastic, such as nylon.

Figure 1:
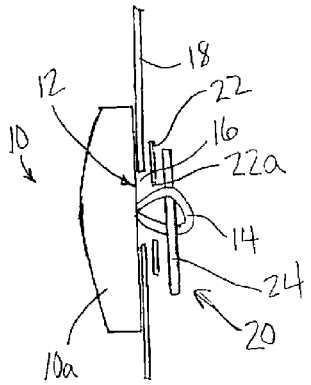
FIG. 1 PRIOR ART
FIG. 1 is a side view of a loop shank button retained in the buttonhole of a garment with a Prior Art fastener arrangement.

In summary, the fasteners 20', 20" of the present invention avoid the difficulty of the Prior Art fastener arrangement 20 illustrated in FIG. 1, providing an improved fastening apparatus that is more easily installed and removed by a user. While the apparatus of the present invention has been described with respect to the illustrated embodiments, it is recognized that numerous modifications and variations in addition to those mentioned herein will occur to those skilled in the art. Accordingly, it is intended that the invention not be limited to the disclosed embodiments, but that it have the full scope permitted by the language of the following claims.

The invention claimed is:

1. A removable fastener for retaining a loop shank button in a buttonhole of a garment, the loop shank button including an ornamental body and a loop shank protruding from a back face thereof, the removable fastener comprising:

a one piece planar disk having a margin and a central portion within said margin that is selectively cut out to define a pair of mutually parallel deflectable legs having free ends that are spaced from said margin and base ends that are joined to said margin, said margin including a region that bridges the bases of said legs and a user manipulated tab extending outward away from the region of said margin that bridges the bases of said legs, said deflectable legs being sized and spaced to permit their insertion through said loop shank, and notched substantially at mid-length to define a detent position in which the loop shank seats to securely attach said one piece planar disk to said loop shank and thereby retain said loop shank button in said buttonhole.

2. The removable fastener of claim 1, where:

the margin of said one piece planar disk extends laterally and longitudinally outward from said deflectable legs in the form of a rounded disk to prevent said fastener from being inadvertently pulled through said buttonhole.

3. A removable fastener for retaining a loop shank button in a buttonhole of a garment, the loop shank button including an ornamental body and a loop shank protruding from a back face thereof, the removable fastener comprising:

a one piece planar disk having a margin and a central portion within said margin that is selectively cut out to define a pair of mutually parallel deflectable legs having free ends that are spaced from said margin and base ends that are joined to said margin, said margin including a region that bridges the bases of said legs, and a circular opening in the region of said margin that bridges the bases of said legs that reduces a width dimension of each of said deflectable legs near their bases to render them more easily deflectable, said deflectable legs being sized and spaced to permit their insertion through said loop shank, and notched substantially at mid-length to define a detent position in which the loop shank seats to securely attach said one piece planar disk to said loop shank and thereby retain said loop shank button in said buttonhole.

4. The removable fastener of claim 3, further comprising:

an opening in said margin longitudinally outboard of the free ends of said deflectable legs so as to expose the free ends of said legs.

5. The removable fastener of claim 3, where:

said margin completely surrounds said deflectable legs, leaving an open space between said margin and a free end of each deflectable leg, said open space having length and width dimensions that exceed those of said loop shank.

* * * * *